US005871307A

United States Patent [19]

Catalano et al.

[11] Patent Number: 5,871,307

[45] Date of Patent: Feb. 16, 1999

[54] PRE-CAST CONCRETE PANEL WALL

[75] Inventors: Nino Catalano, Hingham; Eli Aboukheir, Randolf; Gregory Sanchez, Marshfield, all of Mass.

[73] Assignee: Trevi Icos Corporation, Boston, Mass.

[21] Appl. No.: 616,281

[22] Filed: Mar. 15, 1996

[51] Int. Cl.[6] ..... E02D 5/20

[52] U.S. Cl. ..... 405/267

[58] Field of Search ..... 405/267, 266, 405/275, 264; 106/713, 718, 811

[56] References Cited

U.S. PATENT DOCUMENTS

| | | | |
|---|---|---|---|
| 3,760,594 | 9/1973 | Jurina . | |
| 3,999,394 | 12/1976 | Eberhardt et al. . | |
| 4,073,148 | 2/1978 | Zaretti | 61/42 |
| 4,376,830 | 3/1983 | Niner et al. | 501/140 |
| 4,453,861 | 6/1984 | Bretz et al. . | |
| 4,534,310 | 8/1985 | Quick | 118/620 |
| 4,697,955 | 10/1987 | Le Clerco et al. | 405/124 |
| 4,815,895 | 3/1989 | Purssey et al. . | |
| 4,880,334 | 11/1989 | Miotti . | |
| 4,953,280 | 9/1990 | Kitzmiller . | |
| 5,024,036 | 6/1991 | Johnson | 52/600 |
| 5,056,242 | 10/1991 | Miotti . | |
| 5,079,277 | 1/1992 | Wilson et al. | 523/116 |
| 5,199,819 | 4/1993 | Matiere . | |
| 5,259,705 | 11/1993 | Breaux et al. | 405/267 |
| 5,378,085 | 1/1995 | Kono et al. . | |

FOREIGN PATENT DOCUMENTS

| | | | |
|---|---|---|---|
| 741436 | 12/1932 | France | 405/275 |
| 1094719 | 12/1967 | United Kingdom . | |
| 1252321 | 3/1969 | United Kingdom . | |
| 2 264 739 | 9/1993 | United Kingdom . | |
| 2264739 | 9/1993 | United Kingdom . | |

OTHER PUBLICATIONS

"World's Deepest Cutoff Wall Reaches 430 ft.", Engineering News–Record, 3 pages, Jan. 6, 1972.

"Desperate Need to Slash Construction Costs of New Subways", Civil Engineering–ASCE, 8 pages, Dec., 1976.

Clougherty et al., "Deep Dig, Tight Squeeze", Civil Engineering, 4 pages, Aug., 1994.

Bonneville Dam, Phase II, Washington, ICOS Product Literature.

Shakanai Mine, Ohdate City, in the Akita Municipality, p. 163, The ICOS Company in the Underground Works, I.C.O.S., 1968.

Repair Works of the Temryu–Misakubo Highway Upstream From the Akiba Dam, West of Shitzuoaka (Japan), pp. 306–307, The ICOS Company in the Underground Works, I.C.O.S., 1968.

*Primary Examiner*—Tamara L. Graysay
*Assistant Examiner*—Frederick L. Lagman
*Attorney, Agent, or Firm*—Fish & Richardson P.C.

[57] ABSTRACT

The present invention provides a method of constructing underground structural concrete walls, using pre-cast, preferably pre-stressed, concrete panels, including: (a) casting in place a pair of parallel, opposing, underground guide walls spaced a predetermined distance apart; (b) excavating a trench, using the guide walls to guide the excavation tool, the trench having a predetermined width substantially equal to the space between the guide walls; (c) pouring a footing at the base of the trench; and (d) lowering a pre-cast panel into the trench in a desired orientation relative to the trench walls.

28 Claims, 9 Drawing Sheets

PRE-CAST CONCRETE PANEL WALL

BACKGROUND OF THE INVENTION

The present invention relates to systems and methods for the construction of underground structural concrete walls.

It is often necessary to provide concrete walls below grade, for example in the construction of railroad or highway tunnels, underground parking garages, foundation walls and retaining walls. These underground walls are commonly formed by excavating a trench and pouring concrete into the trench, i.e., casting the wall in place. The physical properties of cast-in-place slurry walls tend to vary depending upon the composition of the concrete, the weather, and other variables present when the concrete is poured.

SUMMARY OF THE INVENTION

The present invention provides an improved method of constructing underground structural concrete walls, using pre-cast concrete panels. Preferably, the panels are also pre-stressed to provide the walls with high strength and resistance to bending moments, e.g., exerted by soil pressure against the wall. Advantageously, the concrete walls have a smooth, finished surface that is substantially free of defects such as inclusions. Moreover, the method of the invention may require less manpower than the construction of conventional cast-in-place slurry walls. Finally, the pre-cast concrete panels can be manufactured under carefully controlled conditions and subjected to quality control, and, if desired, a predetermined preload may be applied to the panels, allowing excellent control over the physical properties of the finished concrete wall.

In one aspect, the method includes: (a) providing, e.g., by casting in place, a pair of parallel, opposing, underground guide walls spaced a predetermined distance apart; (b) excavating a trench, using the guide walls to guide the excavation tool, the trench having a predetermined width substantially equal to the space between the guide walls; (c) pouring a footing at the base of the trench; and (d) lowering a pre-cast panel into the trench in a desired orientation relative to the trench walls.

Preferred embodiments of the invention include one or more of the following features. The footing formed in step (c) is formed of concrete, and is poured into the trench using the tremie method. The method further includes (e) pumping an excavating slurry containing a thickening agent, e.g., bentonite or polymer, into the trench during step (b) to prevent the walls of the trench from collapsing. The method further includes (f) pumping a soil replacement material, e.g., a cement/thickening agent slurry, into the space between the panel and trench walls. This soil replacement material provides support and resists movement of the panels relative to the trench walls when the panel is loaded, and also provides a waterproof barrier. Preferably, each slurry contains from about 3 to 6% bentonite as the thickening agent, and the cement/thickening agent slurry contains cement and bentonite in a ratio of from about 3:1 to 5:1, more preferably 4:1.

In a preferred embodiment of the invention, the guide walls are constructed to support the weight of the panel, and the method further includes the step of suspending the panel from a pair of beams placed transversely across the guide walls and trench opening. The panel is suspended by providing the panel with threaded inserts extending vertically from the upper edge of the panel into the panel, inserting a threaded rod into each of the threaded inserts, passing the threaded rod through an aperture (e.g., a through hole) in the beam, and securing the threaded rod, e.g., with a threaded nut. The elevation of the panel in the trench can then be readily adjusted by raising the panel to unweight the threaded nut and changing the position of the threaded nut on the threaded rod.

In preferred embodiments, the wall is formed of a plurality of pre-cast panels placed side by side in the trench, and the method further includes joining the panels along their adjoining edges. Preferably, the panels are joined by engagement of corresponding interlocking members. Preferred interlocking members include, on one of the adjoining edges, a channel, and, on the opposite edge, a member dimensioned to be received by the channel. It is particularly preferred that the channel and member be keyed for interlocking engagement to provide a secure connection between adjoining panels.

In a particularly preferred embodiment, each of the adjoining edges includes a slot, the slots being positioned so that when the interlocking members are engaged the slots align to define a common slot, and the method further includes introducing into the common slot a liquid, e.g., a polymer, that is curable to form an elastomeric rubber material. Preferably, the elastomeric material is water-swellable. The presence of the elastomer-filled common slot prevents leakage of water through the interface between the panels.

Preferably, when the wall is formed of a plurality of panels, the trench into which the panels are lowered is excavated incrementally, i.e., the entire length of the trench is not excavated prior to placing the panels, but instead a first length of trench is excavated, one or more panels are positioned in this trench, then a further trench is excavated adjacent the first trench. Preferably the entire length of the guidewalls is formed initially, prior to beginning excavation of the trench.

In another aspect, the invention features a method of constructing an underground tunnel. The method includes (i) forming a pair of spaced, opposed vertical walls by the method described above, (ii) excavating to a predetermined roof level, (iii) casting the tunnel roof in place between the vertical walls, (iv) excavating the tunnel to an elevation suitable for the base slab, and (v) casting the base slab in place between the vertical walls.

Preferably, the method further includes (vi) scraping the cement/bentonite slurry (from step (f), above) off of the exposed side of the vertical walls to expose the surface of the precast panel. This step provides the exposed side of each vertical wall with a smooth, finished surface.

The invention also features methods of forming retaining and foundation walls by forming a wall according to a method of the invention and excavation a region adjacent the wall to expose a surface of the wall.

Other features and advantages of the invention will be apparent from the description of preferred embodiments thereof, taken together with the drawings, and from the claims.

DESCRIPTION OF THE PREFERRED EMBODIMENTS

Figure 1:
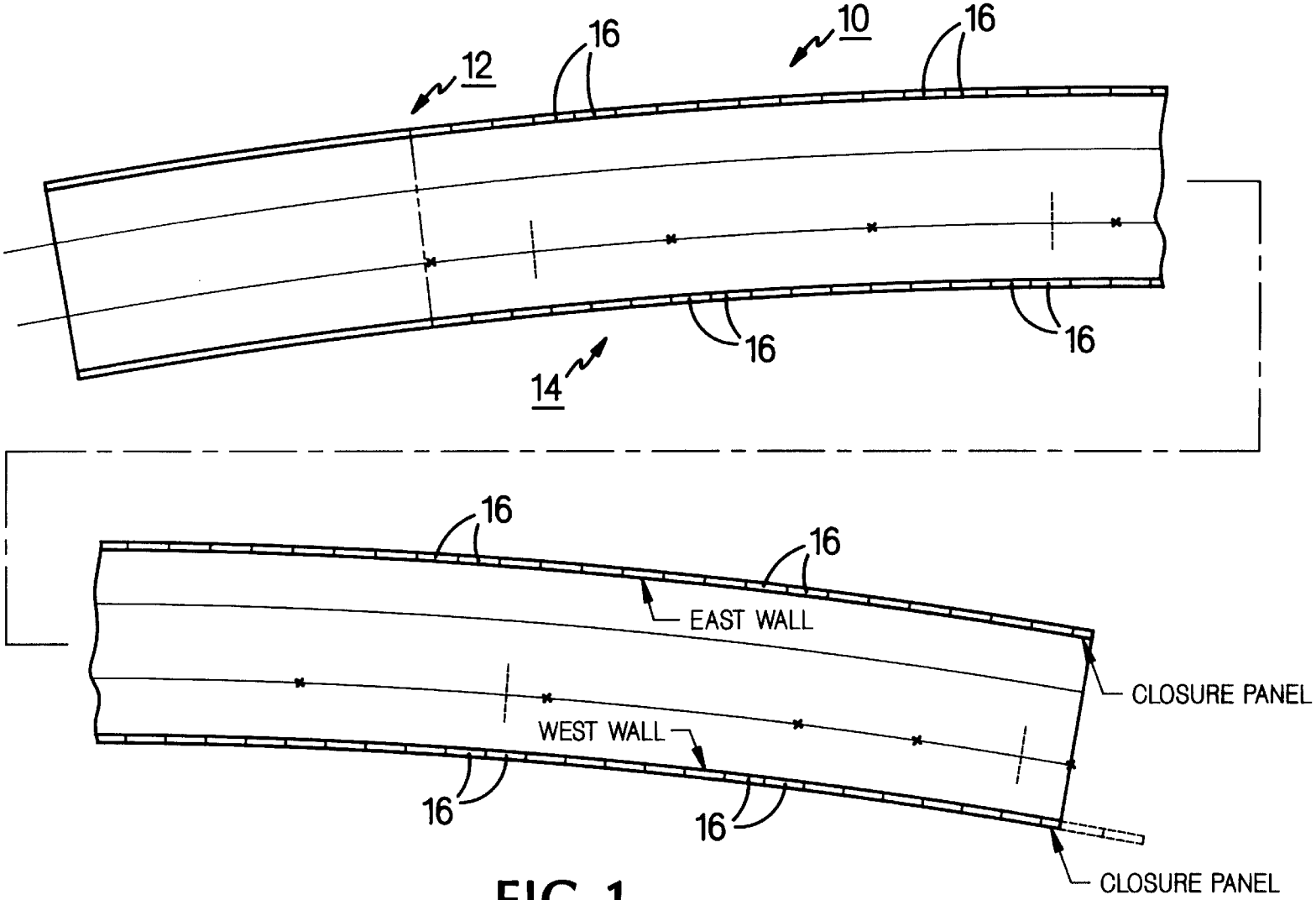
FIG. 1 is a top schematic view of the vertical walls of a tunnel, formed according to one embodiment of the invention.
Figure 1A:
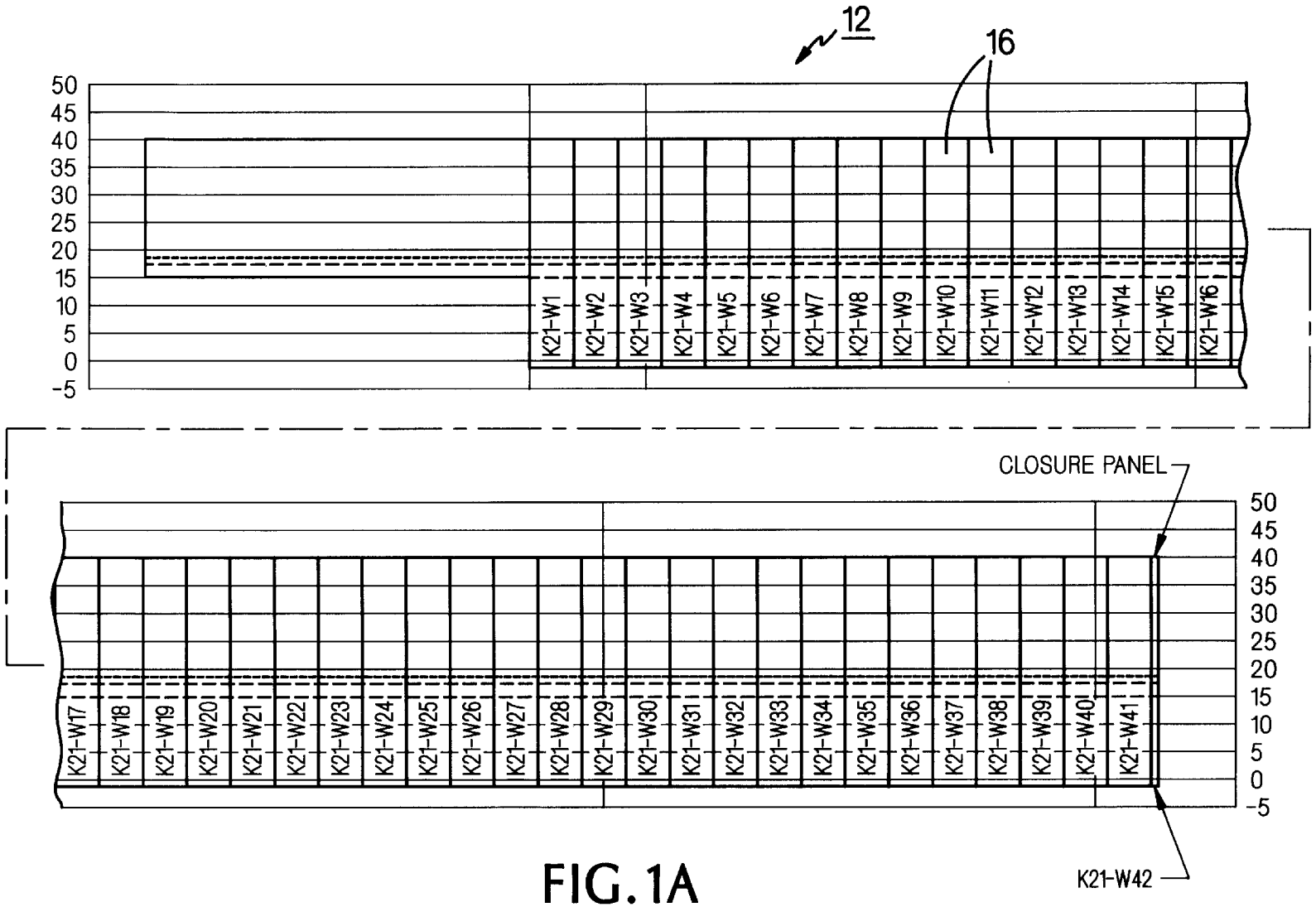
FIG. 1*a* is a side view in elevation of one of the vertical walls.

As shown in FIG. 1, a tunnel 10 includes two opposing vertical walls 12, 14. Each of the opposing walls includes a plurality of pre-cast panels 16 arranged side by side, as shown in FIG. 1*a*.

Figure 2:
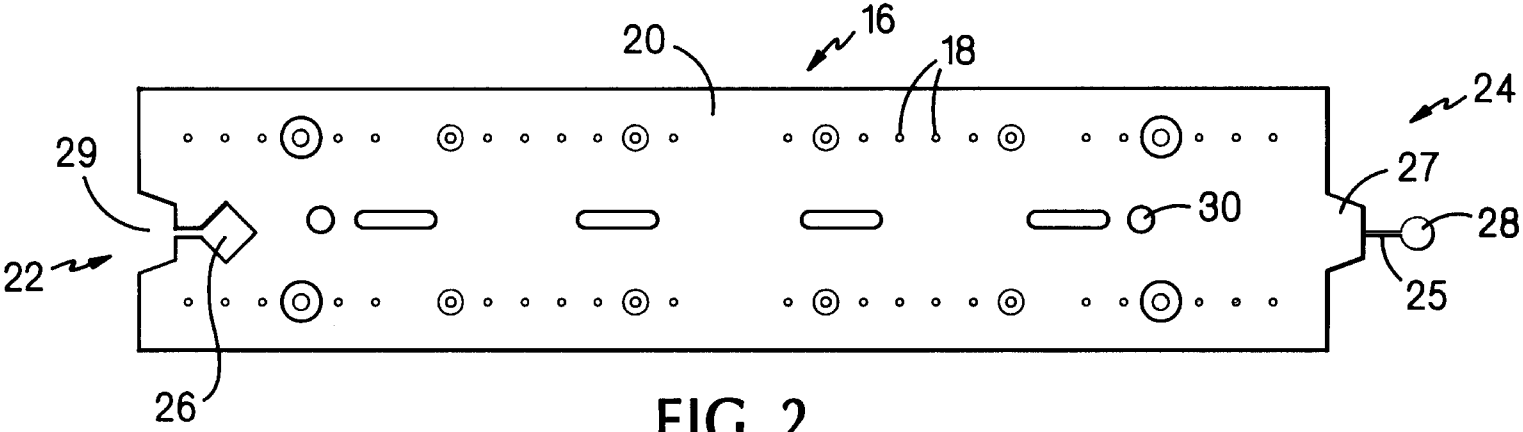
FIG. 2 is a cross-sectional view of a pre-cast panel, taken along line 2—2 in FIG. 3.

Referring to FIG. 2, each pre-cast panel 16 includes a plurality of prestressing strands 18 imbedded in concrete 20. The material used for prestressing strands 18, and the preload applied, may be selected to suit a particular application, as would be understood by a person skilled in the art. In a preferred embodiment, prestressing strands 18 are 7-wire (0.6" diameter) low relaxation strands conforming to ASTM A416 and having an ultimate tensile strength of 270,000 psi. The preload is applied by tensioning the strands to a desired tension prior to pouring the concrete, and releasing the tension from the strands when the strength of the concrete reaches 4000 psi during curing. In the tunnel application described herein a preload of about 2 million pounds was desired due to design considerations. By way of example, to provide this preload, 38 strands were each tensioned to about 44,000 pounds. The strands can typically be tensioned to about 75% of their total yield strength. The total preload can be varied by changing the number of strands used, or the material used to form the strands.

Figure 2A:
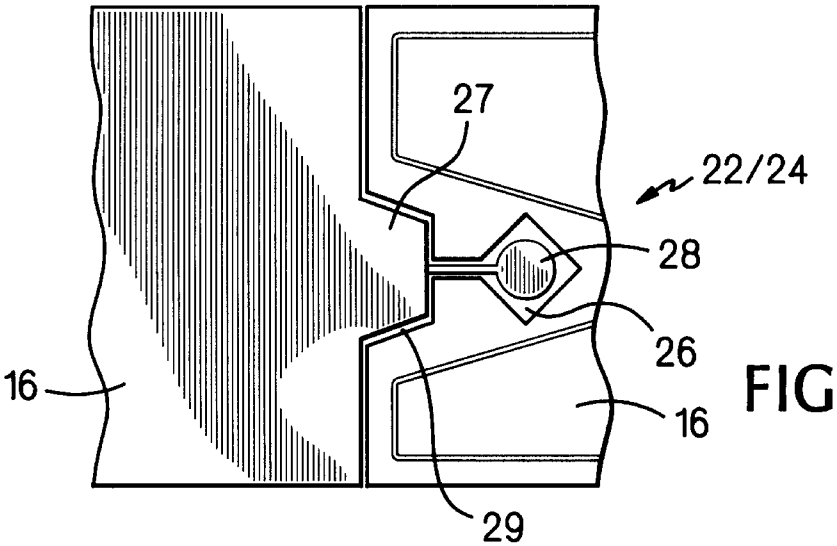
FIG. 2*a* is a detail view showing the engagement of the interlocking members joining two pre-cast panels.

Each pre-cast panel 16 also includes a first interlocking member 22 on one of its longitudinal edges and a second interlocking member 24 on its opposite longitudinal edge. In a preferred embodiment, the first interlocking member includes a channel 26 having a substantially diamond-shaped cross-section, and the second interlocking member includes a rod 28 having a substantially round cross-section and being dimensioned to be received in the channel by sliding the rod downwardly through the upper opening of the channel (see FIG. 2*a*). Rod 28 is mounted on the panel by an elongate member 25. The rod 28 preferably includes two coaxially arranged rod portions that each have a length that is much smaller than the length of the panel. The diamond-shaped cross-section of the channel 26 is preferred over other shapes because it has been found to have good resistance to breakage during and after engagement of the interlocking members. The channel may be formed of angle iron or any other suitable high-strength material. Similarly, the elongate member 25 and rod 28 may be formed of any suitable high strength, rigid material.

Preferably, the interlocking members also include a tongue 27 and groove 29 which interlock in tongue and groove fashion. The combination of the keyed channel and rod and the tongue and groove engagement provides a particularly stable, secure connection between panels, providing dimensional stability to the wall when the wall is placed, positioned and loaded.

Figure 6:
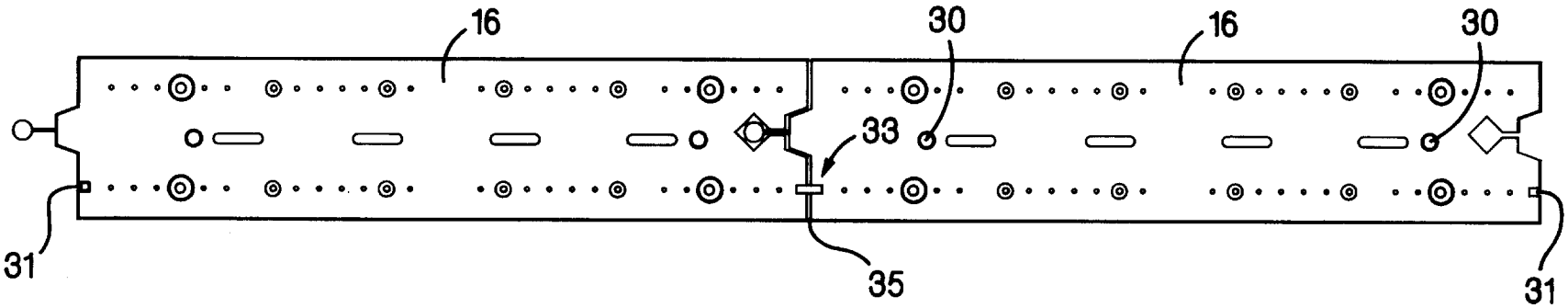
FIG. 6 is a top plan view of adjoining panels according to the invention, showing a common slot containing a water-swellable polymer.

Referring to FIG. 6, in preferred embodiments the pre-cast panels further include a slot 31 extending along each of the vertical edges of the panel. These slots align when the panels are in place, defining a common slot 33 extending vertically between each pair of adjoining panels. A liquid that is curable to form an elastomeric material is poured into the common slot and allowed to cure to form a gasket-like seal 35 between the panels. A suitable liquid is a liquid rubber commercially available from Asahi Denka under the tradename ADEKA ULTRA SEAL® (Product No. A-50), a water-swelling rubber sealing material. This preferred rubber, after curing, has a tensile strength of more than 47 kg/m and an elasticity of greater than 1000%. Importantly, this seal provides a secondary waterproofing barrier against water leakage between the adjoining panels in addition to the barrier formed by the soil replacement material.

In addition, each panel includes a plurality of vertical through holes 30 extending through the interior of the panel. These through holes act as a relief, allowing the concrete at the base of the trench and the bentonite slurry in the trench, displaced by the volume of the panel, to flow into the through holes rather than cause the panel to be buoyed up in the trench. The panels may also include transverse through holes (not shown) through which tie-backs (soil anchors) may be inserted to further stabilize the finished vertical wall, as is well known in the art.

Figure 3:
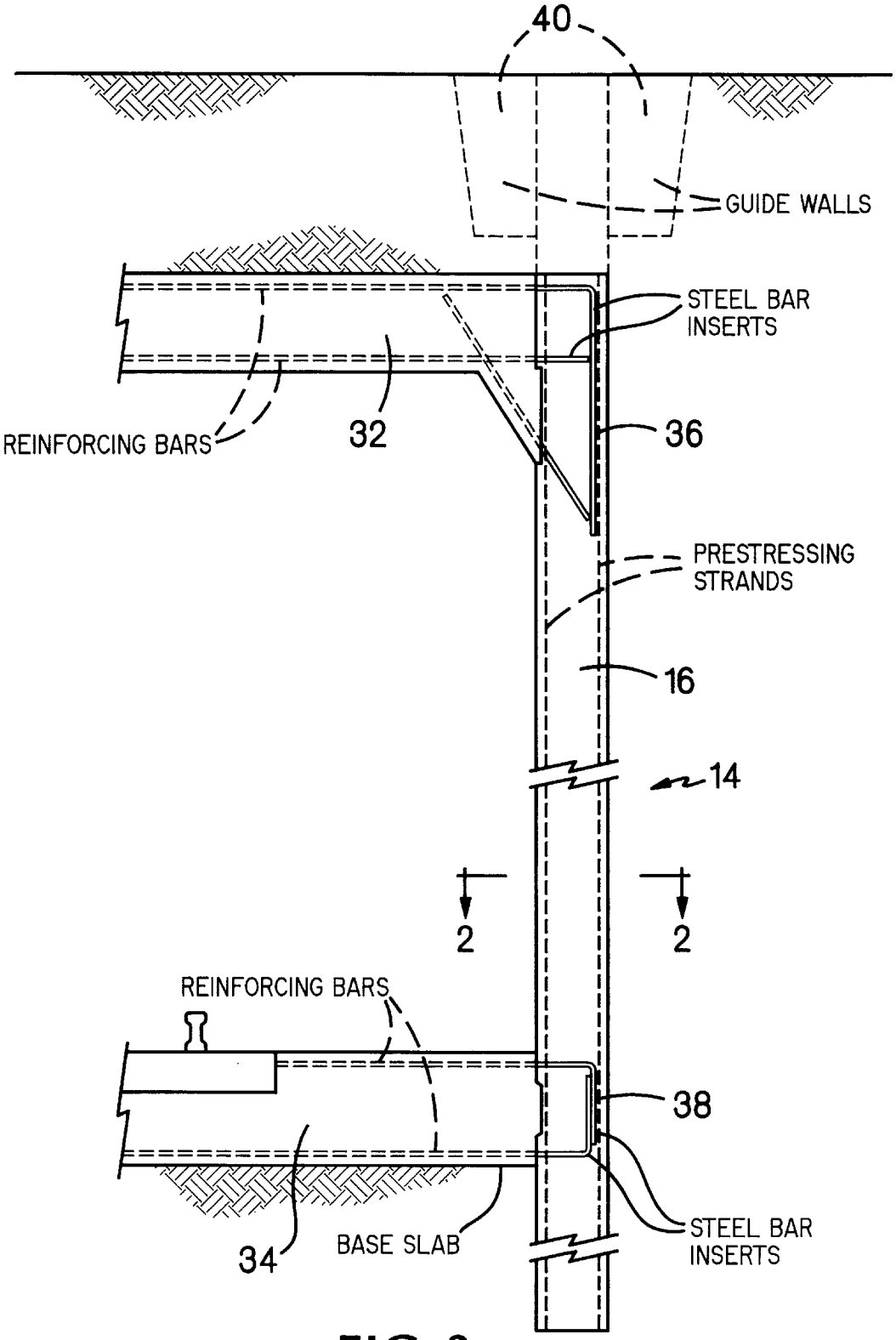
FIG. 3 is a cross-sectional end view of a tunnel formed according to one embodiment of the invention.

One side of a finished tunnel 10 is shown in FIG. 3. In addition to vertical walls 14, the tunnel includes a roof slab 32 and a base slab 34. Threaded steel bar inserts 36, 38 are provided at the intersection of the roof slab and vertical wall and base slab and vertical wall, respectively. These inserts assure the structural continuity of the tunnel structure.

Figure 4:
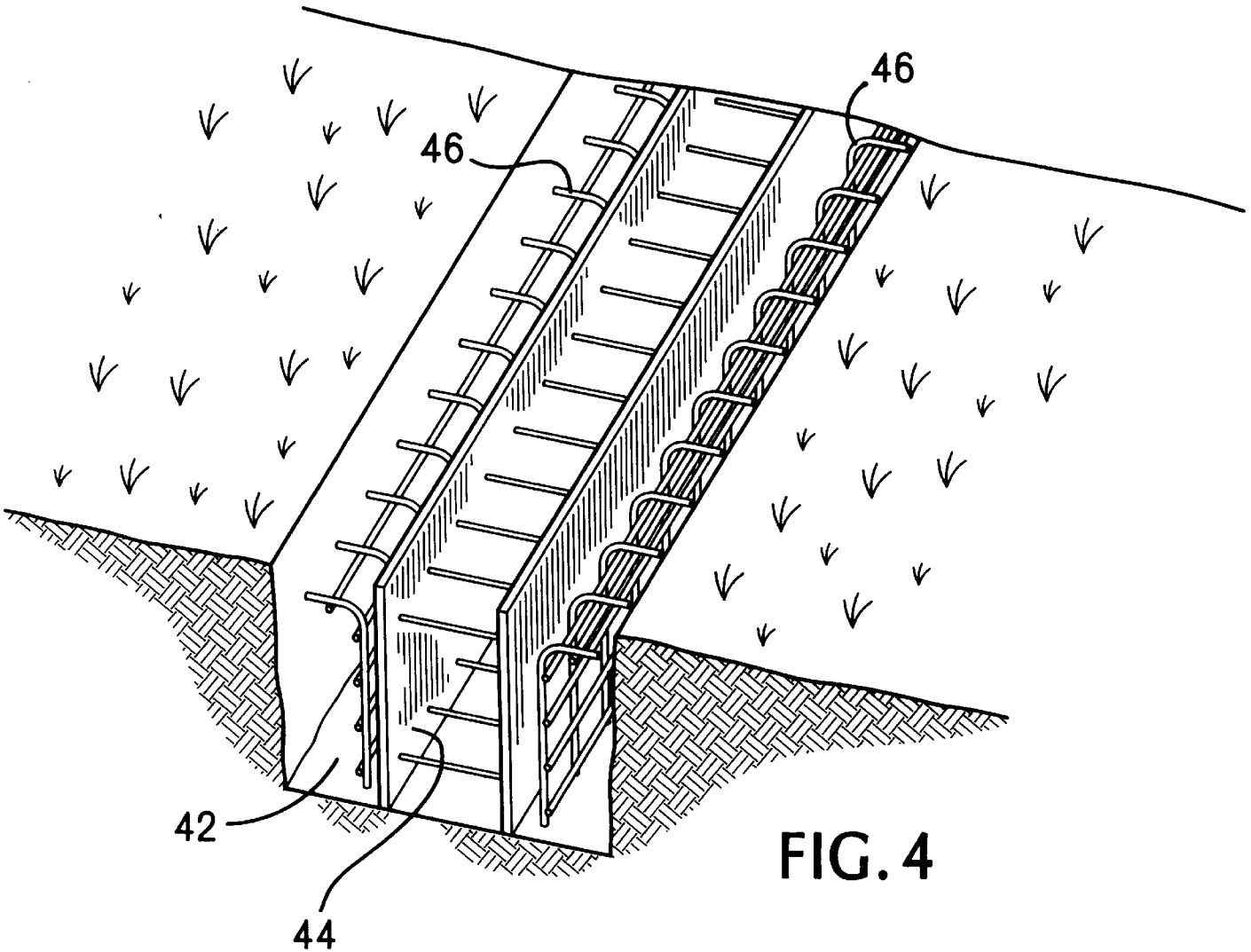
FIGS. 4–4*g* are schematic diagrams illustrating the steps of a method according to one embodiment of the invention.
Figure 4A:
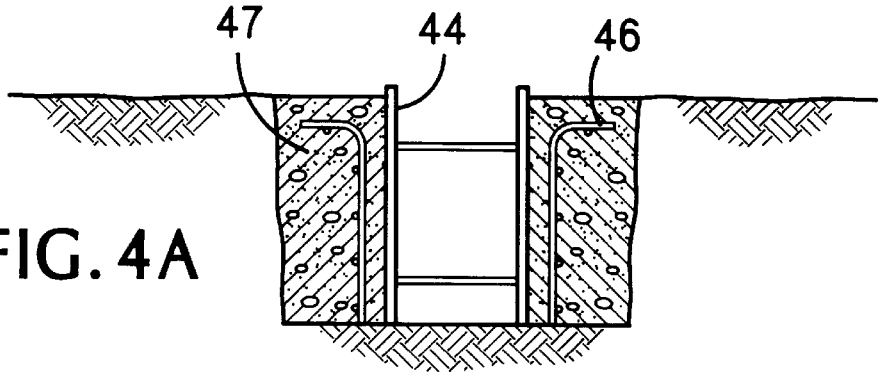
Figure 4B:
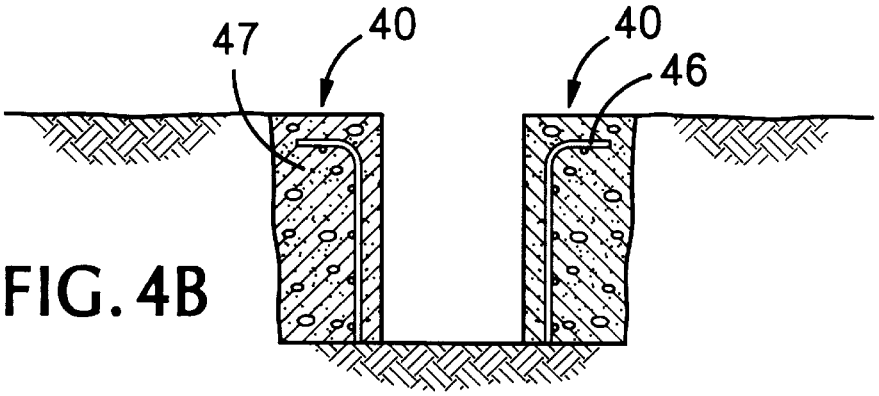
Figure 4C:
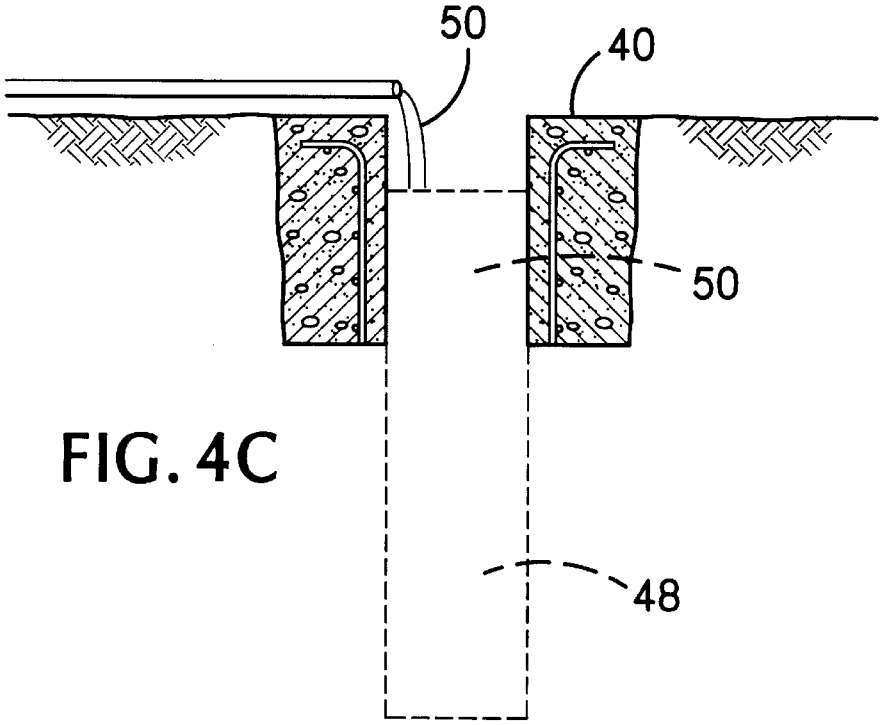
Figure 4D:
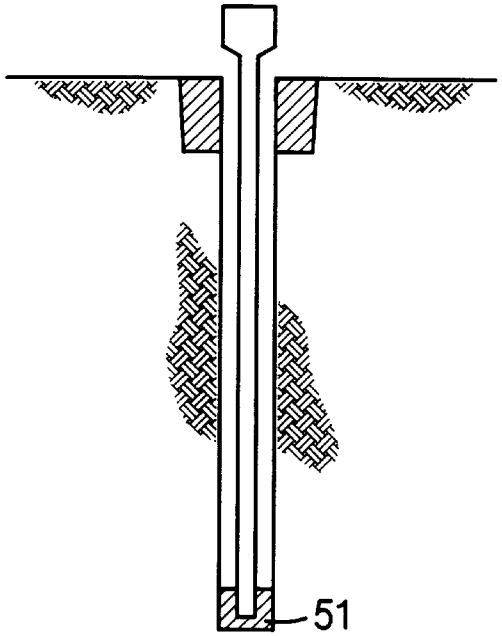
Figure 4E:
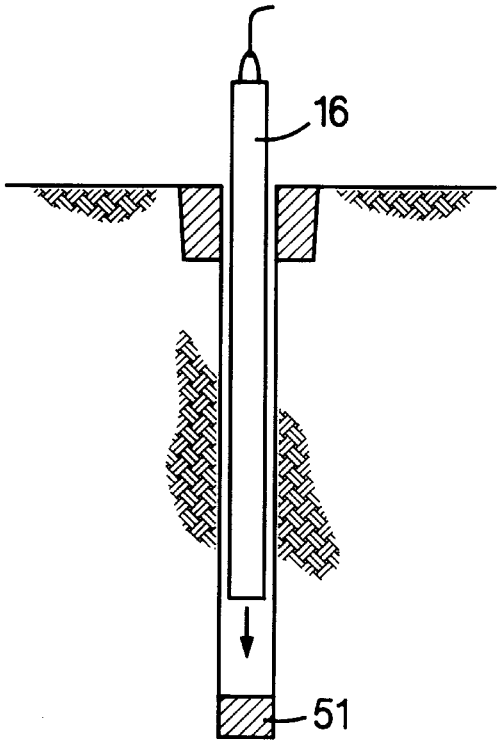
Figure 4F:
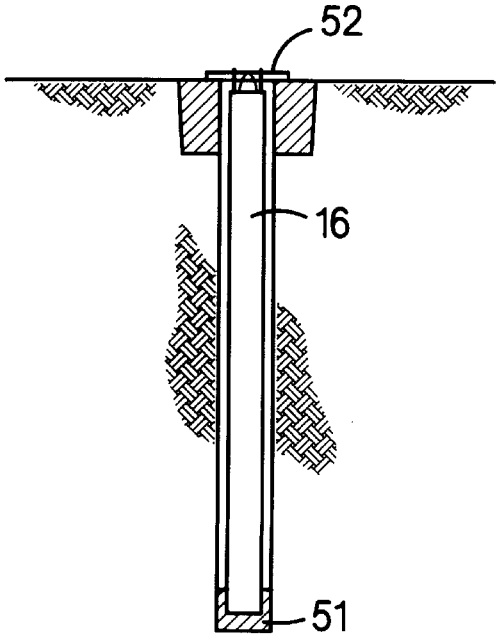
Figure 4G:
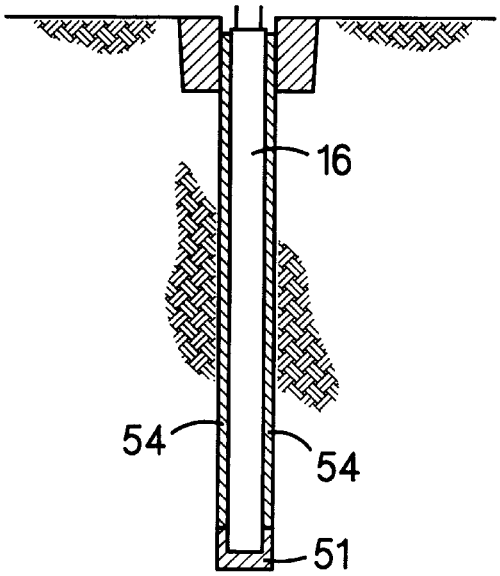
Figure 5:
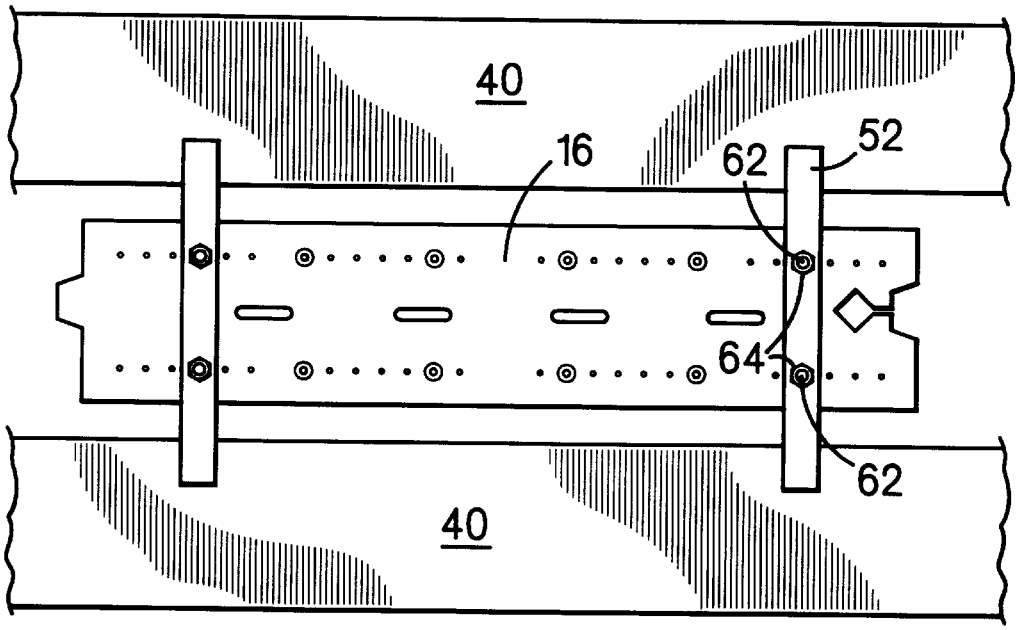
FIGS. 5 and 5*a* are top plan and side cross sectional detail views, respectively, showing the manner in which the panel is suspended in FIG. 4*g*.
Figure 5A:
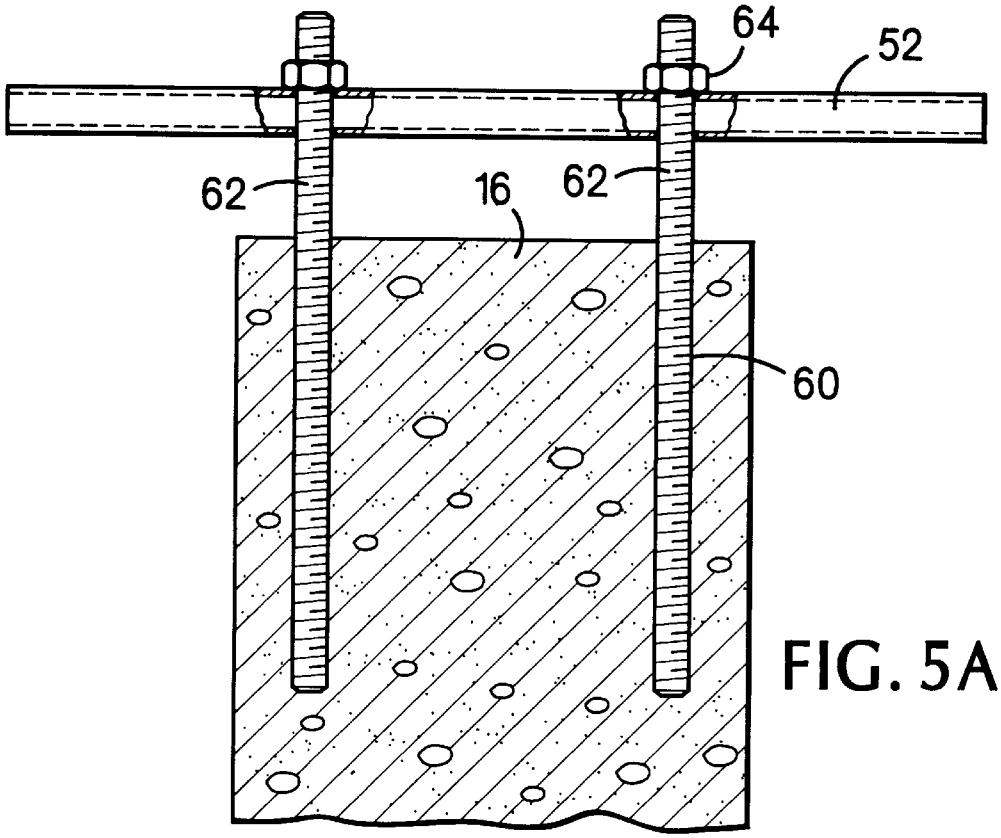

A preferred method of installation of the pre-cast panels is illustrated in FIGS. 4–4*g*. FIGS. 4–4*b* illustrate the initial steps used to form the guide walls 40. First, as shown in FIG. 4, a relatively wide (e.g., 7–8 ft.), shallow (e.g., 4–6 ft.) trench 42 is excavated and formwork 44 and rebar 46 are placed on each side of the trench. Then concrete 47 is poured into each side of the formwork 44 and allowed to cure (FIG. 4*a*), and the formwork is removed (FIG. 4*b*), leaving a pair of opposed guide walls 40 spaced a predetermined distance (the width of the formwork 44) apart. Once the guide walls have been completed, a narrow (e.g., 1 to 3 ft.), deep trench 48 is excavated using the guide walls to guide the excavation bucket, as shown in FIG. 4*c*. During this excavation step, a bentonite slurry 50 is continuously pumped into the trench 48 to prevent the walls of the trench from collapsing. Preferably, the bentonite is a high swelling, Wyoming type, sodium based bentonite consisting mainly of montmorillonite, and the slurry contains a concentration of from about 3 to 6% bentonite in water. The concentration of bentonite will vary depending upon the type of ground to be excavated, as is understood in the art. The slurry is formed by mixing bentonite and water at high shear, as is well known. When excavation has been completed, i.e., when the depth of the trench is substantially equal to the desired height of the vertical wall, the trench bottom is cleaned. The trench preferably has a depth substantially equal to the height of the wall to be formed. Then, concrete footing 51 is placed in the bottom of the trench, preferably using the tremie method as shown in FIG. 4*d*, to a depth at which a small portion (e.g., 1 to 3 ft.) of the bottom edge of the pre-cast panel will be embedded in the concrete when the panel is in place in the trench. Before the concrete has set, pre-cast panels 16 are then inserted into the trench, e.g., by a crane (not shown), one at a time, as shown in FIG. 4*e*, the position of each panel being adjusted until the panel is plumb and level. Each panel is suspended from the upper surface of the guide walls 40, e.g., by a pair of structural steel box beams 52 (FIG. 4*f*). As shown in detail in FIGS. 5 and 5*a*, each panel includes two pairs of threaded inserts 60. A threaded rod 62 is inserted into each of the threaded inserts, and each threaded rod is inserted through apertures in box beam 52 and retained in this position by threading a nut 64 onto each rod above the beam 52. The elevation of the panel is then adjusted by raising the panel sufficiently to unweight the threaded nuts and then adjusting the position of each threaded nut 64 on the threaded rod.

As subsequent panels are placed, the second interlocking member 24 on the panel being placed is engaged with the first interlocking member 22 on the adjoining, previously placed panel (see FIG. 2*a*), to securely join the panels together. Finally, a soil replacement material 54, e.g., a cement/bentonite slurry, is pumped into the area between the panels and the trench walls (FIG. 4*g*) to provide support to the panels and resist movement of the panel relative to the trench walls when the panel is loaded. Preferred soil replacement materials, such as the cement/bentonite slurry, also provide a barrier to infiltration of water or moisture from the soil through the wall or between the panels.

To construct a tunnel as shown in FIG. 3, panels are installed as shown in FIGS. 4–4*g*, to form a first vertical wall, and installed in similar manner to form a second vertical wall spaced a predetermined distance from the first vertical wall and substantially parallel thereto. Then, the area between the vertical walls is excavated to the design level of the lower surface of the tunnel roof, and the roof slab is cast in place. Next, the tunnel is excavated, under the cured roof slab, to the level of the lower surface of the base slab, and the base slab is cast in place.

Other embodiments are within the claims. For example, although the method has been described above in the context of tunnel construction, the method is useful in many other underground wall applications.

Moreover while a preferred method of prestressing the pre-cast panels has been described, other prestressing techniques could be used, as would be understood by a person skilled in the art.

Further, while preferred interlocking members are illustrated herein, other interlocking arrangements can be used, e.g., the channel and/or the rod may have a different cross-sectional shape.

Additionally, while the precast panels have been illustrated as being suspended from the guide walls so that their upper edge is slightly below grade level, the panels could be placed so that a portion of the panel extends above grade level, or suspended in a manner that would allow the upper edge of the panel to be further below grade level, if desired.

If desired, the concrete that is placed in the bottom of the trench prior to insertion of the panel may instead be placed in the bottom of the trench after insertion of the panel, e.g., by providing a vertical through hole through the interior of the panel having a sufficient diameter to allow the concrete to be tremied through the panel.

While bentonite has been described as the preferred thickening agent for use in both slurries, either slurry can include a different thickening agent. Other suitable thickening agents, e.g., polymers, for excavating slurries are well known in the oil drilling art.

Moreover, other soil replacement materials could be used instead of a cement/bentonite slurry. Suitable materials are those that could be pumped into the space between the panel and trench walls and that would provide support equal to or greater than that of soil, e.g., lean concrete, cement/atapulgite slurry and flowable fill.

Moreover, rather than using two slurries, an excavating slurry and a soil replacement slurry, a single, thickening agent/concrete slurry can be used for both steps. Alternatively, a curing additive can be added to the thickening agent/water slurry, after insertion of the panel, to cause the slurry to solidify.

Figure 7:
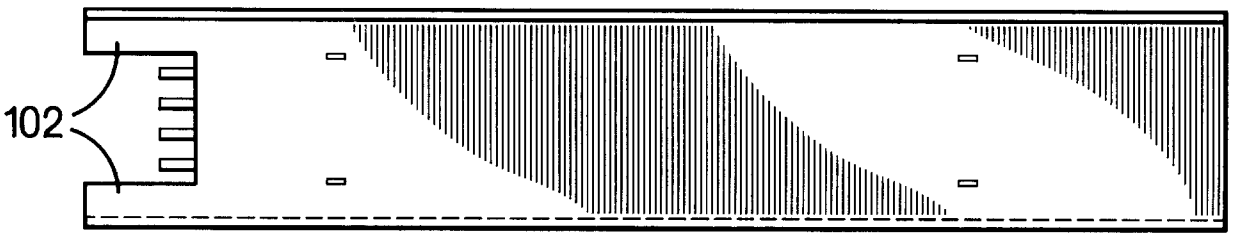
FIG. 7 is a front view of a panel according to an alternate embodiment of the invention.

The pre-cast panels need not be rectangular, as shown. For example, as shown in FIG. 7, in an alternate embodiment the precast panel includes a pair of "arms" 102 that allow the upper edge of the panel to be placed below grade level. These arms may be cut off after the panel is in place, allowing the soil above the upper edge of the panel to be excavated after the wall has already been formed.

What is claimed is:

1. A method of constructing an underground structural concrete wall comprising:

(a) providing a pair of parallel, opposing, underground guide walls spaced a predetermined distance apart;

(b) excavating a trench, using the guide walls to guide an excavation tool, the trench having a predetermined width substantially equal to the space between the guide walls;

(c) pouring a footing at the base of the trench; and (d) lowering a pre-cast panel into the trench and into the footing in a desired orientation relative to the trench walls.

2. A method of claim 1 wherein said pre-cast panel is pre-stressed.

3. A method of claim 2 wherein said pre-cast panel is pre-stressed by pouring concrete around one or more tensioned wires and releasing the tension from the wires after the concrete attains a predetermined strength.

4. A method of claim 2 wherein the pre-cast panel carries a preload of about 2 million pounds.

5. A method of claim 1 further comprising pumping an excavating slurry containing a thickening agent into the trench during step (b) to prevent the walls of the trench from collapsing.

6. A method of claim 1 further comprising pumping a soil replacement material into the space between the panel and trench walls, to provide support and resist movement of the panel relative to the trench walls when the panel is loaded.

7. A method of claim 6 wherein said soil replacement material comprises a slurry comprising cement, thickening agent and water.

8. A method of claim 5 or 7 wherein said thickening agent is bentonite.

9. A method of claim 8 wherein each slurry contains from about 3 to 6% bentonite.

10. A method of claim 7 wherein the ratio of cement to thickening agent is about 3:1 to 5:1.

11. A method of claim 1 further comprising selecting the trench depth, depth of the footing formed in step (c), and panel height so that the bottom edge of the panel extends about 1 to 5 feet into the footing and the top edge of the panel is approximately at ground level.

12. A method of claim 1 wherein the wall is formed of a plurality of pre-cast panels, and the method further includes inserting a second pre-cast panel adjoining the first pre-cast panel and joining the pre-cast panels along their adjoining edges.

13. A method of claim 12 wherein the pre-cast panels are joined by engagement of corresponding interlocking members.

14. A method of claim 13 wherein the interlocking members comprise a channel disposed along the edge of one of the pre-cast panels and a member dimensioned to be received by the channel disposed along the adjoining edge of the other pre-cast panel.

15. A method of claim 14 wherein the channel and member are keyed for interlocking engagement.

16. A method of claim 15 wherein the channel has a substantially diamond-shaped cross-section.

17. A method of claim 16 wherein the member has a substantially round cross-section.

18. A method of constructing an underground tunnel comprising:

(i) forming a pair of spaced, opposed vertical walls, each wall being formed by:

(a) providing a pair of parallel, opposing, underground guide walls spaced a predetermined distance apart, the guide walls having a depth that is significantly less than the height of the wall to be formed;

(b) excavating a trench, using the guide walls to guide an excavation tool, the trench having a predetermined width substantially equal to the space between the guide walls;

(c) pouring a footing at the base of the trench; and (d) placing a pre-cast panel into the trench and into the footing in a desired orientation relative to the trench walls;

(ii) excavating the area between the vertical walls to a predetermined roof level;

(iii) casting a tunnel roof in place between the vertical walls;

(iv) excavating a tunnel beneath the tunnel roof to a predetermined tunnel base elevation; and (v) casting a base slab in place between the vertical walls.

19. A method of constructing an underground structural concrete wall comprising:

(a) providing a pair of parallel, opposing, underground guide walls spaced a predetermined distance apart;

(b) excavating a trench, using the guide walls to guide an excavation tool, the trench having a predetermined width substantially equal to the space between the guide walls;

(c) pouring a footing at the base of the trench; and (d) placing a pre-cast, pre-stressed panel into the trench and into the footing in a desired orientation relative to the trench walls.

20. A method of constructing an underground structural concrete wall comprising:

(a) providing a pair of parallel, opposing, underground guide walls spaced a predetermined distance apart;

(b) excavating a trench, using the guide walls to guide an excavation tool, the trench having a predetermined width substantially equal to the space between the guide walls;

(c) pouring a footing at the base of the trench; and (d) placing a first pre-cast panel into the trench and into the footing in a desired orientation relative to the trench walls, said first pre-cast panel having a slot along at least one of its vertical edges;

(e) placing a second pre-cast panel into the trench and into the footing adjacent the first pre-cast panel, said second pre-cast panel having a slot along at least one of its vertical edges, and aligning said slots to define a common slot; and (f) introducing into the common slot a liquid that is curable to form an elastomeric material, the elastomeric material providing a waterproofing barrier.

21. A method of claim 20 wherein the elastomeric material is water-swellable.

22. A method of claim 20 wherein the polymer is curable by exposure to air and/or moisture.

23. A method of claim 20 wherein the pre-cast panels are joined by engagement of corresponding interlocking members.

24. A method of claim 23 wherein the interlocking members comprise a channel disposed along the edge of one of the pre-cast panels and a member dimensioned to be received by the channel disposed along the adjoining edge of the other pre-cast panel.

25. A method of claim 24 wherein the channel and member are keyed for interlocking engagement.

26. A method of claim 25 wherein the channel has a substantially diamond-shaped cross-section.

27. A method of constructing an underground structural concrete wall comprising:

(a) providing a pair of parallel, opposing, underground guide walls spaced a predetermined distance apart;

(b) excavating a trench, using the guide walls to guide an excavation tool, the trench having a predetermined width substantially equal to the space between the guide walls;

(c) pouring a footing at the base of the trench; and (d) placing a pre-cast panel into the trench and into the footing in a desired orientation relative to the trench walls, said pre-cast panel having a pair of threaded inserts extending vertically into the panel from its upper edge, and a pair of threaded rods received by said threaded inserts;

(e) placing a beam transversely across the guide walls and the trench above the upper edge of the panel, said beam having apertures dimensioned to receive said threaded rods, and inserting said threaded rods through said apertures;

(f) securing said threaded rods in said apertures by attaching a threaded nut to each threaded rod above said beam; and (g) adjusting the elevation of the panel by unweighting the threaded nuts and adjusting the position of said threaded nuts on said threaded rods.

28. A method of constructing a retaining or foundation wall comprising:

(i) forming an underground wall by:

(a) providing a pair of parallel, opposing, underground guide walls spaced a predetermined distance apart, the guide walls having a depth that is significantly less than the height of the wall to be formed;

(b) excavating a trench, using the guide walls to guide an excavation tool, the trench having a predetermined width substantially equal to the space between the guide walls;

(c) pouring a footing at the base of the trench; and (d) placing a pre-cast panel into the trench and into the footing in a desired orientation relative to the trench walls; and (ii) excavating a region adjacent the wall to expose a surface of the wall.

* * * * *